United States Patent [19]

Boesen

[11] 4,234,914

[45] Nov. 18, 1980

[54] INCANDESCENT DISPLAY SYSTEM

[75] Inventor: Raymond J. Boesen, Glenview, Ill.

[73] Assignee: Stewart-Warner Corporation, Chicago, Ill.

[21] Appl. No.: 20,077

[22] Filed: Mar. 13, 1979

[51] Int. Cl.[3] ..... F21V 29/00

[52] U.S. Cl. ..... 362/240; 362/294; 362/373; 40/550

[58] Field of Search ..... 362/227, 234, 236, 240, 362/241, 294, 367, 373, 812; 40/550

[56] References Cited

U.S. PATENT DOCUMENTS 2,295,863 9/1942 Paradis ..... 362/294

2,597,680 5/1952 Sissler ..... 362/294

*Primary Examiner*—Donald P. Walsh

*Attorney, Agent, or Firm*—McDougall, Hersh & Scott

[57] ABSTRACT

An incandescent display system suitable for use in displaying video images is disclosed. Incandescent lamps are positioned closely to each other in order to achieve a high resolution picture. The lamps are mounted in modules which can be removed from the rear of the display for periodic servicing. The modules include openings to permit cooling air to flow over the surface of the lamps and the display system enclosure is pressurized to create a constant flow of air for this purpose.

4 Claims, 5 Drawing Figures

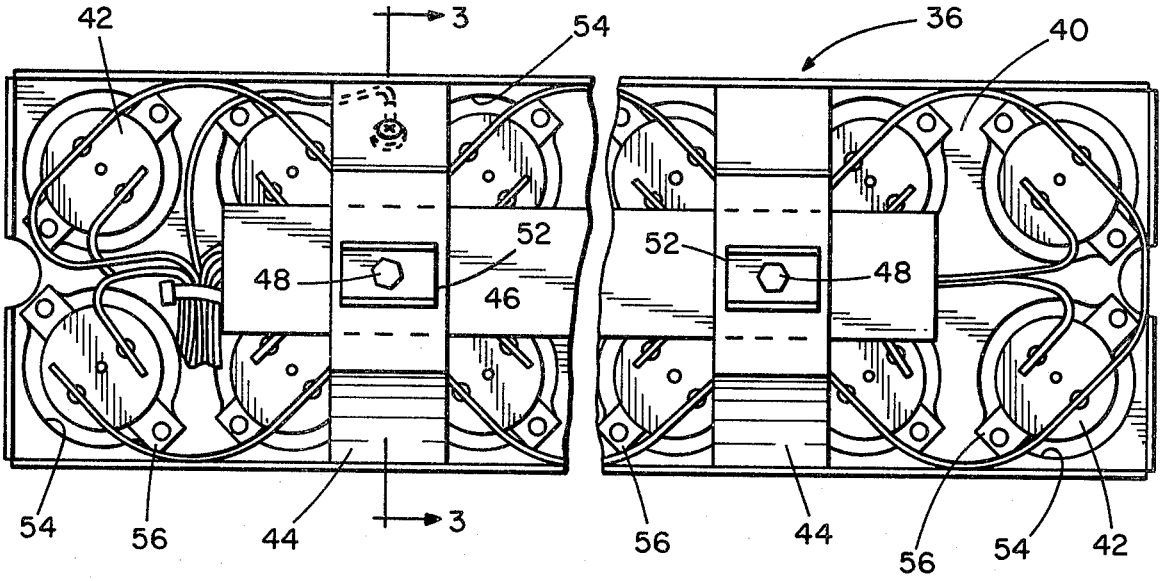
FIG. 2
FIG. 3
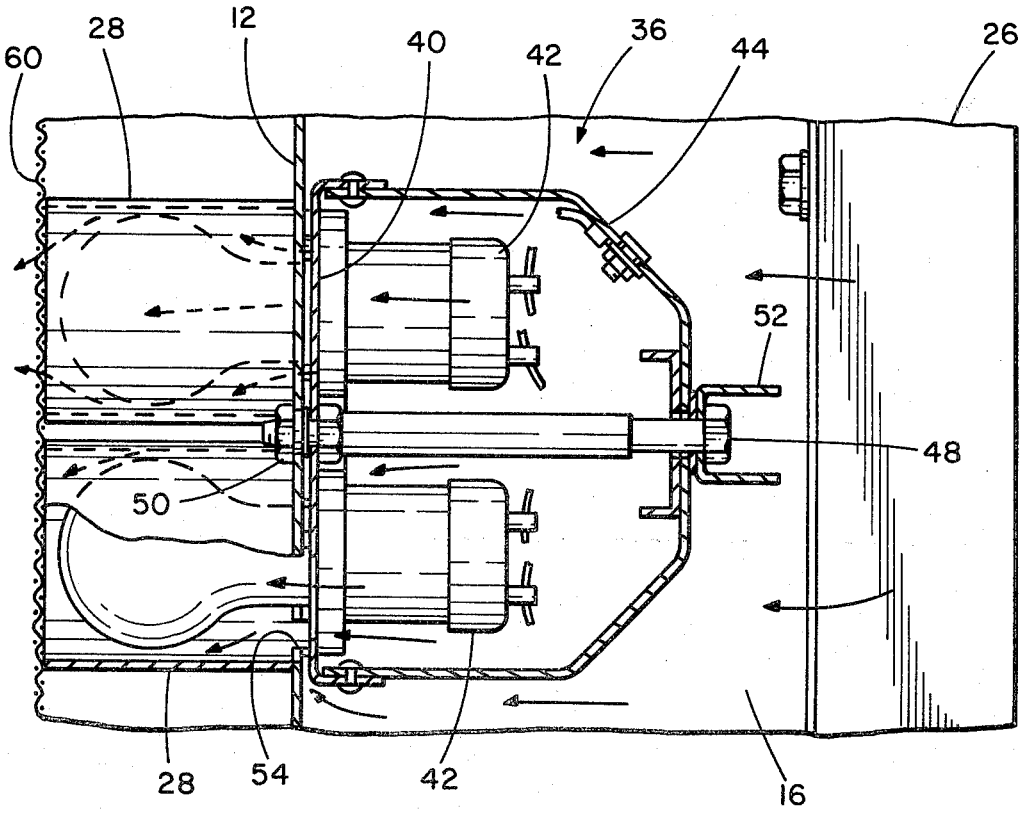

INCANDESCENT DISPLAY SYSTEM

A problem which is encountered with displays of this type is the need to easily service the lamps on a periodic basis. In prior designs it was necessary to service the lamps from the front of the board, often in full view of the spectators and exposed to the weather. It required the servicing technicians be on a ladder or scaffold. Also, the servicing must be performed while the board is not in use or else servicing procedures will interfere with the display images.

It is accordingly an object of the present invention to provide an improved incandescent display board in which high resolution is obtained by the use of high density spacing of the incandescent lamps.

It is a further object of the invention to provide a display board in which the excessive heat caused by close spacing of incandescent lamps is dissipated by means of a pressurized cooling system.

Another object of the invention is to provide rear service access to the lamps so that they may be serviced from inside an enclosure behind the display board protected from the elements and without the need for the servicing technician to be perched on a scaffold or ladder.

A further object of the invention is to provide a modular rear service lamp tray which can be easily removed for servicing and/or replacement, if necessary.

These and other objects of the invention will be apparent from the remaining portion of the specification.

BRIEF DESCRIPTION OF THE DRAWINGS

FIG. 2 is a rear elevational view of a lamp tray assembly.

FIG. 3 is a sectional view along the lines 3—3 of FIG. 2 illustrating the air flow through the tray assembly, into the reflector and out the front face of the module.

DETAILED DESCRIPTION

Figure 1:
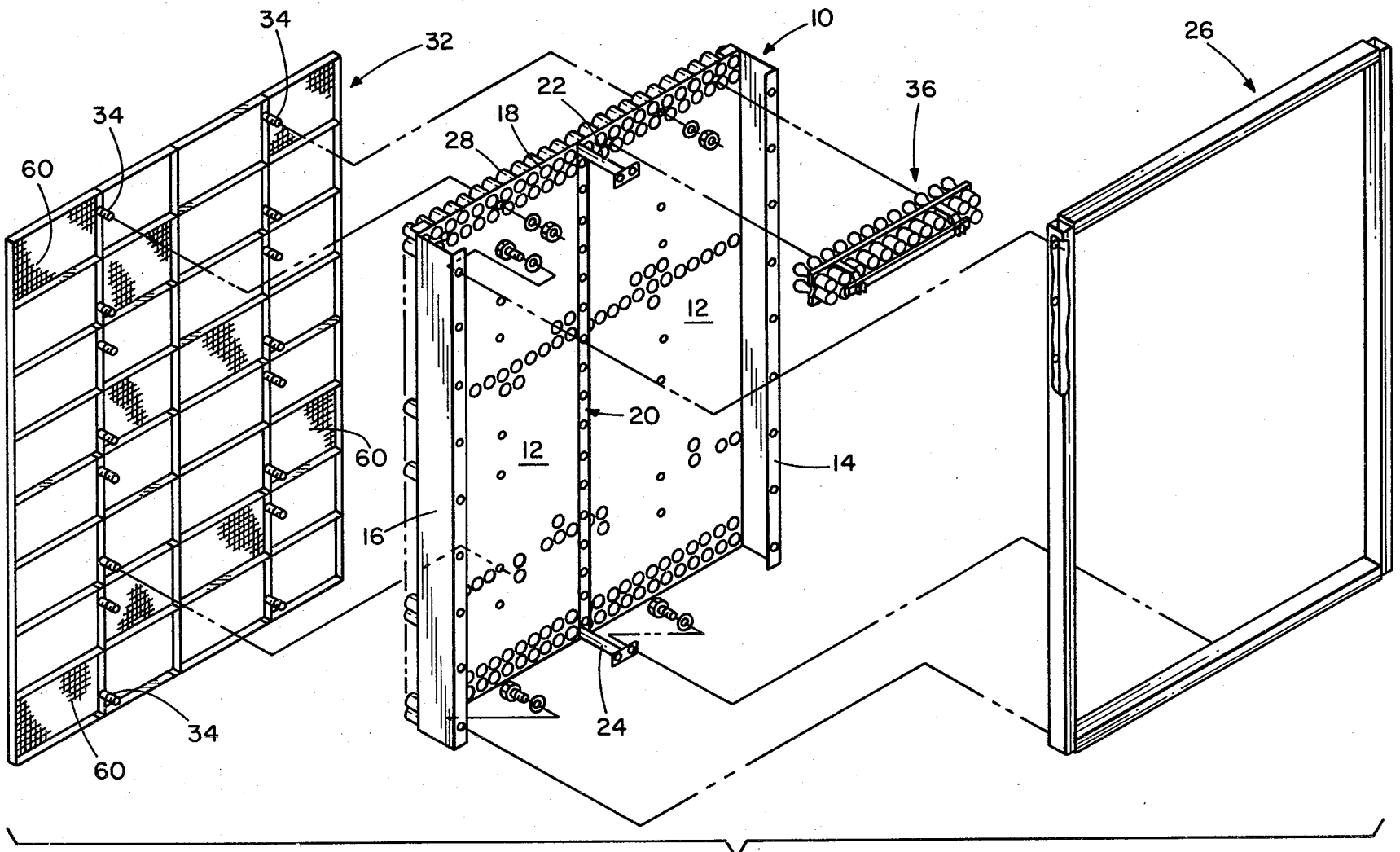
FIG. 1 is an exploded view of the construction details of the sun screen and supporting structure for the incandescent lamps.

Referring to FIG. 1, there is illustrated a structure 10 comprising two panels 12 of generally rectangular configuration. End panels 14 and 16 are integrally formed parts of panels 12. A plurality of circular openings 18 are cut into the panels 12 as indicated. Panels 12, 14, 16 and 20 are preferably formed out of one piece of sheet metal. Panels 12 are stiffened by a short panel 20 riveted to join panels 12 together. Attached to the panel 20 are upper and lower support members 22 and 24, respectively.

Because of the large number of apertures provided in the panel 12 additional rigidity is required. This is provided by attaching the structure 10 to a rear frame 26. Frame 26 is rectangular in configuration and preferably comprises hollow steel tubing welded at its ends. The frame 26 is open in its central portion to permit air flow therethrough. The frame 26 is attached to side panels 14 and 16 and to the upper and lower support braces 22 and 24 in a conventional manner as by welding or bolting.

The rigid composite structure is then provided with a plurality of reflector sleeves 28. Reflector sleeves 28 are hollow cylinders of sufficient length to completely enclose an incandescent lamp therein. The sleeves 28 are attached to the panel 12 by means of tabs 30 (FIG. 4) which are received in corresponding slots provided on the panel 12. One sleeve is provided for each opening 18 in the panel 12. After the tabs of the sleeve pass through the slots surrounding the openings 18, which preferably are the same diameter as the inside of the sleeve, the tabs are flattened against the panel 12 to secure the sleeves.

After the sleeves have been positioned over the front of panel 12, the sun screen indicated at 32 is ready to be secured over the sleeves 28. The structure 32 appears to be a unitary structure but, in fact, it is preferably a plurality of individual screen panels which can be more easily installed. Each individual screen panel is placed over an appropriate section of the panel 12 on the front side thereof. The screens are secured in position by bolting the studs 34 to the panel 12 as indicated in the drawing. The screens are preferably formed of stainless steel which has been painted black to increase light absorption thereby reducing glare from sunlight. Various screen sizes and diameters of screen wires can be employed. It is preferred to use a screen which has $18 \times 18$ squares per inch formed from wire which is 0.009 inches in diameter.

The black screen serves two important functions. First, it prevents insects and birds from entering the display module. Second, it reduces the amount of sunlight impinging upon the lamps. The black wire tends to absorb a portion of this light and by so doing significantly increases the visibility of the display during daylight operation.

As partially illustrated in FIG. 1, the lamps to be received in the sleeves 28 are mounted on a lamp tray assembly 36. Assembly 36 is adapted to be positioned over the holes 18 in the panel 12 whereby each individual lamp enters a corresponding sleeve 28. The assembly is then secured to the backside of the panel 12 by threaded bolts.

Figure 4:
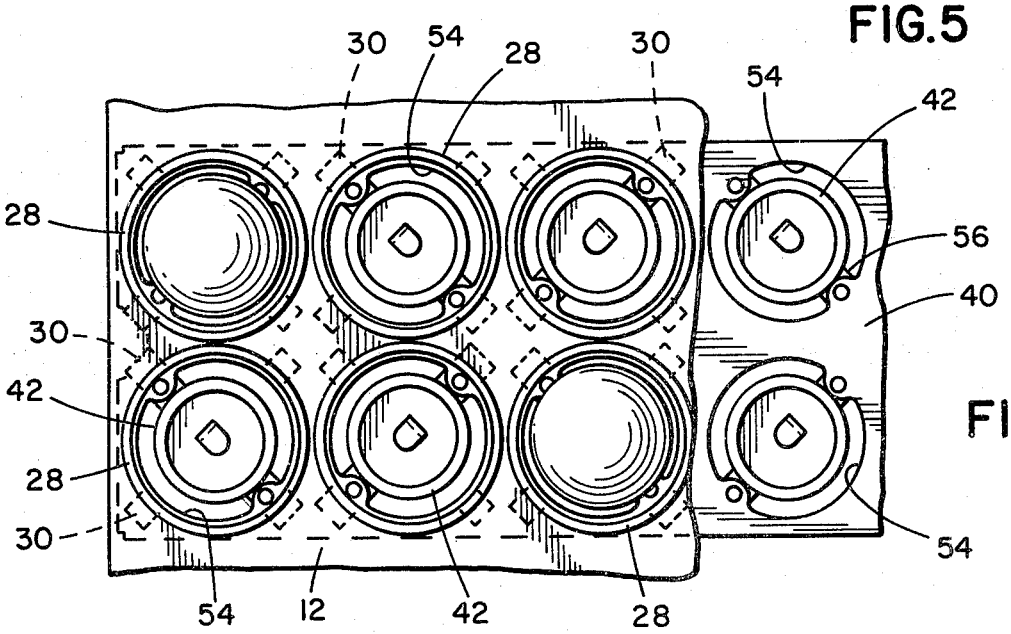
FIG. 4 is a front elevational view of a portion of the lamp tray assembly.

The details of the lamp tray assembly 36 are best illustrated in FIGS. 2 through 4 to which reference will now be made. As seen in FIG. 3, the lamp tray assembly 36 comprises a chassis 40 to which a plurality of lamp sockets 42 are mounted. Secured to the chassis at the top and bottom portions thereof are a pair of handle bales 44 to which a handle 46 is connected. As will be appreciated, this construction permits the entire lamp tray assembly to be removed merely by grasping the handle 46 when the assembly has been unbolted from the panel 12. The assembly is secured to the panel 12 by means of a pair of bolts 48 which pass through the bales and extend forwardly to and through the surface 12 where they are secured by a caged nut 50 or other suitable means. To permit easy installation and removal, the bolt 48 may have winged handles 52 whereby they may be removed by hand without the need for a wrench or other tool. In the secured position illustrated in FIG. 3 it will be observed that the chassis 40 is firmly seated against the rear surface of the panel 12 spaced only by the thickness of the tabs 30.

An important feature of the invention, as has been stated, is the ability to closely position the lamps for high density packing to obtain improved picture resolution. In order to do so it is necessary to force cool the lamps to prevent destructive heat build up. For that purpose the openings on the chassis 40 to which the sockets 42 are secured are significantly larger than the diameter of the socket. Thus, an uncovered annular opening 54 remains around each socket through which air can pass.

In order to accommodate this construction, the sockets 42 are secured to the chassis 40 by means of ears 56 extending slightly beyond the openings 54. As indicated in FIG. 2, this construction is effective for permitting air to flow around the sockets 42, through the oversized openings 54 and into the sleeves 28. Thus, the air flows over the surface of the incandescent lamps and then passes out of the sleeves at the front thereof and out through the sun screen. This effects the necessary cooling to permit the lamps to be closely spaced. In particular, incandescent lamps of approximately 40 watts may be spaced as close together as $2\frac{3}{8}$ inches between centers without heat damage. Without this cooling provision it would be necessary to space the lamps at a much greater between center distance, which would adversely affect picture resolution.

Figure 5:
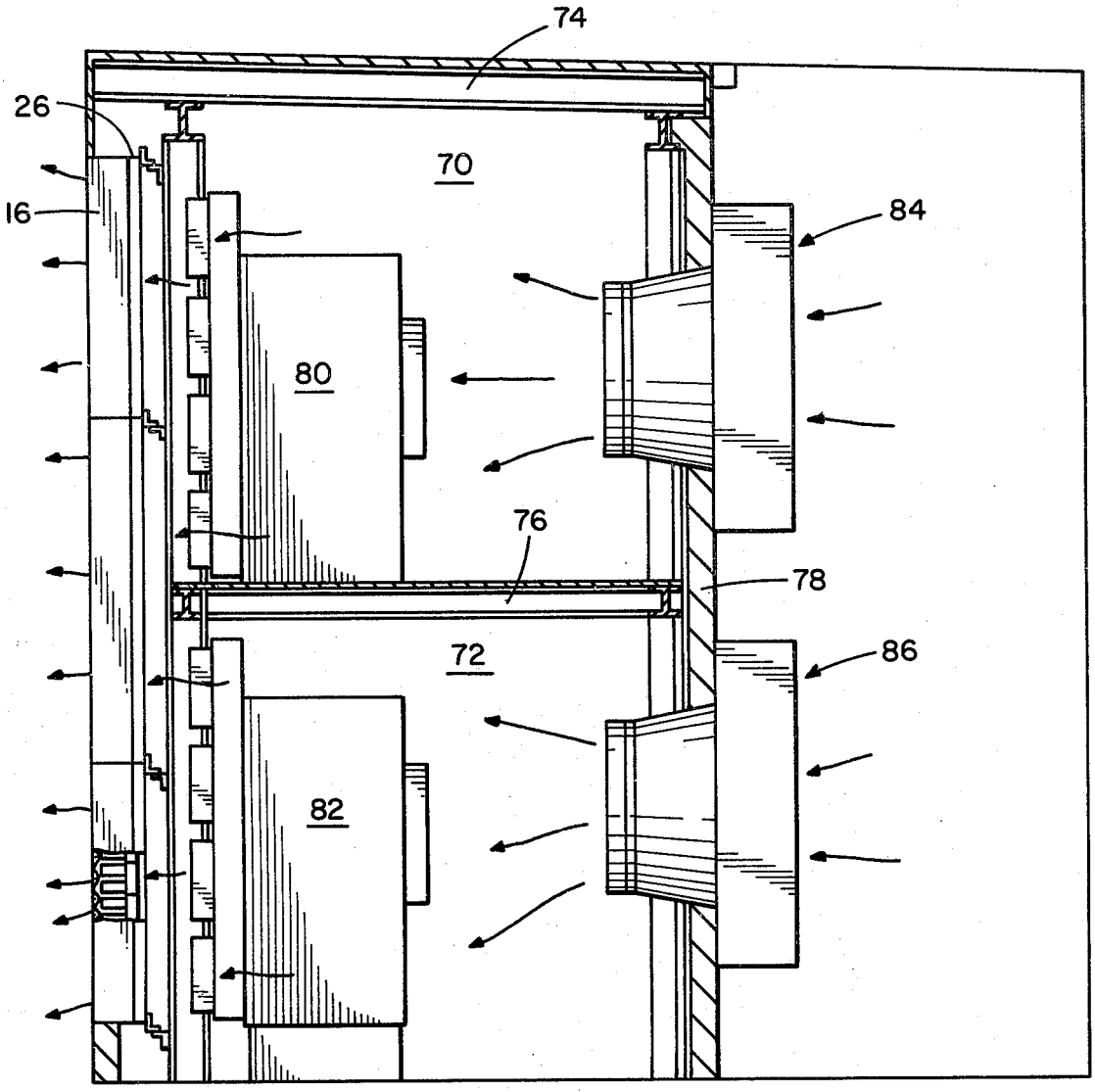
FIG. 5 is a side elevational view illustrating the details of pressurizing the display board for cooling purposes.

Referring now to FIG. 5, a preferred means by which an air flow is caused to pass through each sleeve to cool the lamps is illustrated. The display board frame including the side walls 14 and 16 and the rear frame 26 are shown as forming the front side of an enclosure having an upper half 70 and lower half 72 or any number of service levels dictated by the ultimate size of the matrix display. Top, sides and back of the enclosure are formed in any convenient fashion as by conventional contruction including steel support members 74 and 76 and block walls 78. Control cabinets for the lamp modules are shown at 80 and 82. Provided through one of the walls are a plurality of fans as at 84 and 86. Of course, other ways of pressurizing the enclosure 70 and 72 can be utilized as, for example, by connecting the enclosure with duct work to an air conditioning system.

In either case the criteria for pressurizing the enclosure is as follows. A high output lamp matrix, as described, can generate in excess of one kilowatt per square foot of heat and, therefore, must be forced air cooled to maintain the components within safe operating temperatures. Cooling air is drawn into the structure from the outside while contamination, insects, rain, etc., are carefully filtered to prevent their entrance into the enclosure where they could damage the components and degrade the appearance of the lamp matrix.

For 40 watt incandescent lamps on approximately $2\frac{3}{8}$ inch centers it has been empirically determined that a minimum air flow of approximately 2.5 cfm past each lamp is necessary for proper cooling when the outside temperature is above 48° F. For temperatures below 48° F. a minimum air flow past the lamps of 1.75 cfm is satisfactory. Of course, for different lamp spacings and wattages, different air flow requirements would be called for. In general, the value of the air flow must be sufficient to disperse enough heat generated by the bulbs to maintain normal operating temperature ranges. Fan assemblies 84 and 86 are preferably provided with intake air filtration to prevent dust, etc., from entering the system. In addition, the system is preferably outfitted with a power louver so that when the system is not operating the louvers are closed to prevent entry of excessive moisture into the enclosure.

From the foregoing description, it will be apparent that during operation of the lamp displays the fan assemblies 84 and 86 pressurize the enclosure. This forces air through the opening 54 in the chassis 40 surrounding each socket. The air then passes into the sleeves 28 flowing along the surface of the lamps. The air picks up the heat from the lamp and carries it outwardly past the screen 60 to the outside. Thus, constant cooling of the lamp is obtained permitting the close spacing on center without any deterioration in the normal service life of the lamps, sockets or wiring.

When servicing of a module is required as, for example, to change burned out lamps, each lamp tray assembly 36 is easily removed from the panel 12 by unscrewing the bolts 48 and withdrawing the lamps from the sleeves 28. The lamps may then be serviced and the lamp tray assembly reinserted into position on the panel 12.

While I have shown and described embodiments of this invention in some detail, it will be understood that this description and illustrations are offered merely by way of example, and that the invention is to be limited in scope only by the appended claims.

I claim:

1. A lamp tray assembly for an incandescent lamp display system including an enclosure having a front panel with a plurality of openings therethrough for the receipt of incandescent lamps said tray assembly comprising:

(a) a chassis having a pluraity of openings therein, (b) a plurality of lamp sockets, each secured over one of said chassis openings and adapted to receive an incandescent lamp therein, said sockets being smaller in size than the chassis openings so that air may pass through said openings to cool the incandescent lamps, (c) means for releasably securing said tray assembly including said chassis and lamp sockets to said front panel from the rear side thereof during operation of said display system and permitting removal of the tray assembly from said front panel to periodically service the incandescent lamps.

2. The lamp tray assembly according to claim 1 wherein said chassis openings are circular and said sockets are of a smaller diameter than said openings thereby to let air pass through the annular space defined between the circumference of the socket and the circumference of the chassis opening.

3. The lamp tray assembly according to claim 1 wherein said tray assembly further includes handle means secured to said chassis permitting easy withdrawal of the tray assembly from the display system for servicing.

4. The assembly according to claim 1 wherein said chassis openings are spaced one from the other at less than 2.5 inches center to center thereby to produce a high density display having improved visual display resolution.

* * * * *